United States Patent [19]

Koch

[11] 4,375,279

[45] Mar. 1, 1983

[54] BOBBIN ASSEMBLY

[75] Inventor: Keith E. Koch, Tremont, Ill.

[73] Assignee: Caterpillar Tractor Co., Peoria, Ill.

[21] Appl. No.: 278,504

[22] PCT Filed: Mar. 23, 1981

[86] PCT No.: PCT/US81/00377

§ 371 Date: Mar. 23, 1981

§ 102(e) Date: Mar. 23, 1981

[51] Int. Cl.[3] ..... B65H 59/04

[52] U.S. Cl. ..... 242/156; 242/75.4; 242/129.8; 57/13; 87/21; 188/71.9; 188/83

[58] Field of Search ..... 242/156, 156.2, 129.8, 242/75.4, 55.3, 54 R, 86.7, 99; 57/9, 13, 14, 15, 16, 17; 87/21, 56, 57; 188/71.9, 83, 170, 196 M

[56] References Cited

U.S. PATENT DOCUMENTS

| | | | |
|---|---|---|---|
| 2,277,134 | 3/1942 | Nelson | 242/156 X |
| 2,385,479 | 9/1945 | Underhill | 242/156 X |
| 2,405,446 | 8/1946 | Perrault | 242/75.4 X |
| 2,445,607 | 7/1948 | Ghetto | 242/156 X |
| 3,137,985 | 6/1964 | Bailey | 57/13 |
| 3,439,483 | 4/1969 | Brown | 57/16 X |
| 3,590,567 | 7/1971 | Bonikowski et al. | 57/3 |
| 3,720,054 | 3/1973 | Haehnel et al. | 57/13 X |
| 3,907,229 | 9/1975 | Iannucci et al. | 242/156 X |

FOREIGN PATENT DOCUMENTS

| | | | |
|---|---|---|---|
| 2807111 | 8/1978 | Fed. Rep. of Germany | 242/156 |
| 631789 | 9/1927 | France | 242/156 |

*Primary Examiner*—Stanley N. Gilreath
*Attorney, Agent, or Firm*—Robert A. McFall

[57] ABSTRACT

A bobbin assembly (10) is disclosed for simultaneously dispensing a plurality of wires and controllably maintaining a predetermined tension on the wires.

In the construction of a high pressure, multiple-ply, wire reinforced hose, it is necessary that each of the wires be applied at a uniform, predetermined tension. The present invention solves this problem by providing each spool assembly (12) of a multiple spool bobbin assembly (10) with an internally disposed adjustable brake assembly (22). The brake assembly (22) of the present invention imparts a controllable and uniform resistance to the rotation of a supply reel (20) in each of the spool assemblies (12). The present invention is particularly useful in the construction of high pressure hydraulic hose products.

13 Claims, 4 Drawing Figures

BOBBIN ASSEMBLY

DESCRIPTION

Technical Field

This invention relates generally to a bobbin assembly and more particularly to a bobbin assembly for simultaneously disposing a plurality of wires and controllably maintaining a predetermined tension of low magnitude on the wires.

Background Art

In the construction of multiple ply, wire-wound articles, such as high pressure hydraulic hose, it is highly desirable that each individual wire be equally tensioned and that each multiple wire ply of the construction be applied at a predetermined, uniform tension. In the construction of a typical high pressure hose as many as 100 to 150 individual wires may be simultaneously wound about a mandrel. If each wire is not uniformly tensioned, the lesser-tensioned strands will have a tendency to lie above the plane of adjacent wires, and higher-tensional wires will have a tendency to become buried in preceding plys and lie below adjacent wires. Unequal wire tension results in non-uniform wire lay, poor radial positioning of individual strands, and a less than desirable finished product.

In response to the desire to construct high quality wire-wound articles, a number of attempts have been made to control the tension of wire strands during construction of such articles. One approach has been to employ a spring biased take-up device between the wire supply reel and the article being constructed. Such devices are effective for controlling slack in the wire but generally provide inadequate control of wire tension.

Other attempts to control wire tension are directed to the provision of various supply reel braking devices such as the spring-loaded brake shoes disclosed in U.S. Pat. No. 3,720,054, issued to Rudolf H. Haeknel, et al, on Mar. 13, 1973. Supply reel braking devices have, heretofore, been only limitedly successful in controlling wire tension. Generally, currently known braking devices are bulky, do not provide equal braking action throughout each revolution of the supply reel, and suffer from a variation of tension control in response to the rotational speed of the reel. In addition, current braking devices require frequent readjustment during operation and do not lend themselves to incorporation in multiple reel bobbin assemblies.

The present invention is directed to overcoming one or more of the problems as set forth above, and includes a bobbin assembly having a plurality of spool assemblies mounted on a common shaft. Each of the spool assemblies has a wire supply reel and an adjustable brake assembly internally disposed within the reel. The brake assembly controllably maintains a uniform predetermined tension on the wire as the wire is dispensed to an article.

DISCLOSURE OF THE INVENTION

In accordance with one aspect of the present invention, a bobbin assembly for dispensing a plurality of wires and controllably maintaining a predetermined tension on the wires, includes a shaft, a plurality of hubs mounted on the shaft in a fixed relationship with the shaft, and a plurality of reels each rotatably mounted on a respective hub. The bobbin assembly also includes a friction member positioned between a pair of reaction members on each of the hubs and a means for biasing at least one of the reaction members toward an associated friction member.

In the construction of a high quality, multiple-ply, wire reinforced hose, it is required that each of the individual strands of wire be supplied to a forming mandrel at a uniform predetermined tension. The present invention solves this problem by providing each spool of a multiple spool bobbin assembly with an internally positioned, adjustable brake assembly. The brake assembly imparts controllable and uniform resistance to the rotation of a supply reel and maintains a uniform tension on the wire throughout each revolution of the reel.

The present invention provides a bobbin assembly that enables the construction of a wire-wound article having a more uniform wire lay, i.e., less high or buried wires, and improved radial positioning of the applied wires. The present invention also provides an improved, easily serviceable and adjustable brake assembly for maintaining a uniform tension of very low magnitude on the wire during a single revolution of the reel.

BEST MODE FOR CARRYING OUT THE INVENTION

Figure 1:
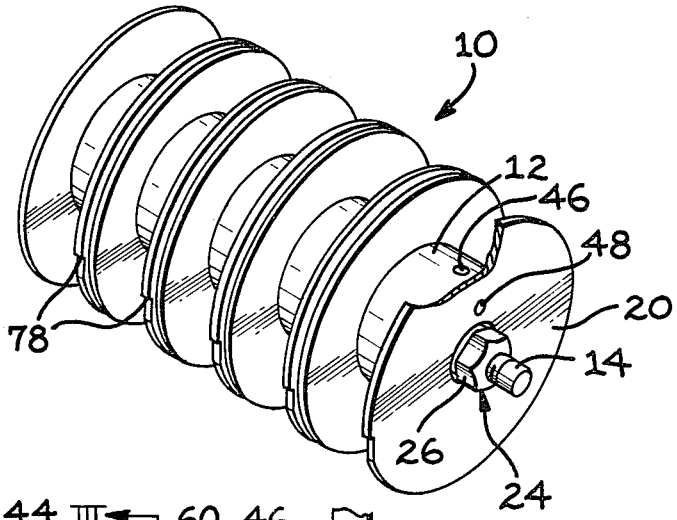
FIG. 1 is an isometric view of a multiple spool bobbin assembly of the present invention.
Figure 2:
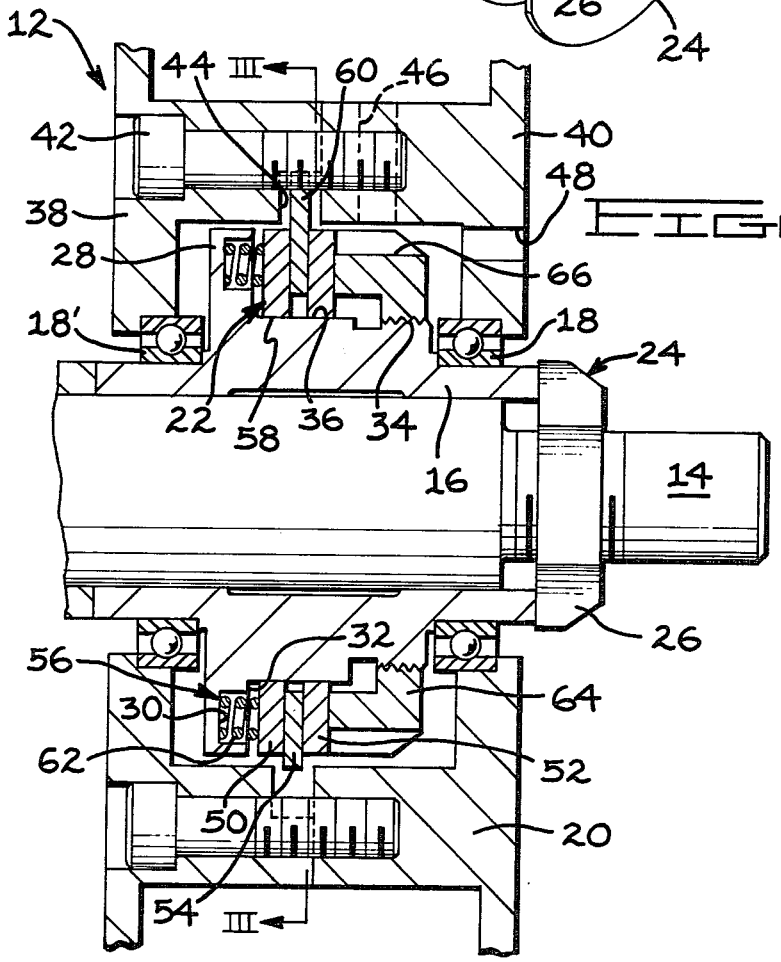
FIG. 2 is a longitudinal sectional view of a single spool assembly of the bobbin assembly of the present invention.
Figure 3:
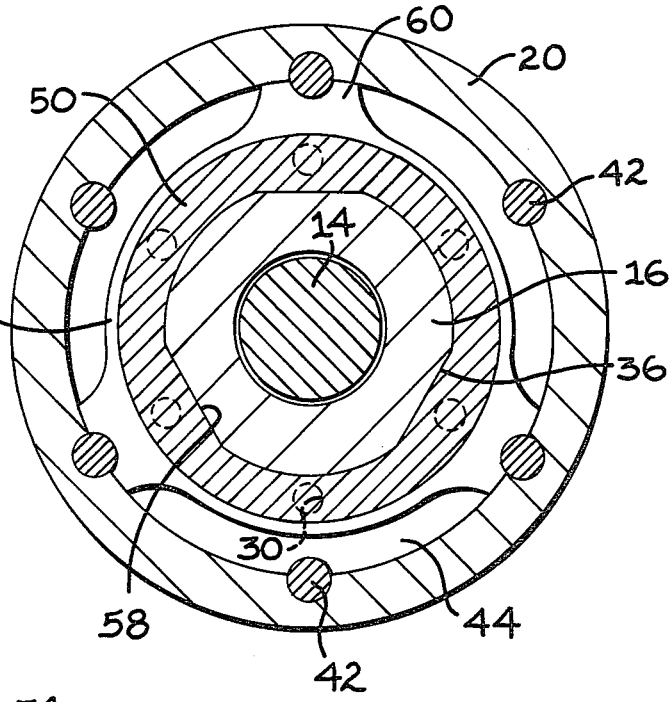
FIG. 3 is a cross-sectional view of a spool assembly of the bobbin assembly of the present invention taken along lines III—III of FIG. 2.

A bobbin assembly for simultaneously dispensing a plurality of wires and controllably maintaining a predetermined tension of low magnitude on the wires is generally indicated by the reference numeral 10. In the preferred embodiment, the bobbin assembly 10 includes a plurality of spool assemblies 12, as shown in FIG. 1, mounted on a single shaft 14. Each of the spool assemblies 12, as shown in FIGS. 2 and 3, include a hub 16 mounted on the shaft 14, a pair of bearings 18,18' mounted on the hub 16, a reel 20 rotatably mounted on the bearings 18,18', and a brake assembly as generally indicated by the reference numeral 22 positioned radially inwardly of the reel 20. A means 24 for maintaining the hubs 16 in a fixed relationship with respect to the shaft 14 includes a nut 26 threadably mounted on each end of the shaft 14. The nuts 26 are tightened, or drawn toward each other, thereby drawing all of the hubs 16 into an abutting relationship with respect to each other. The hubs 16 are maintained in a fixed relationship with each other and with the shaft 14 by the restraining action provided by the tightened end nuts 26.

The hub 16 includes a radial flange 28 having a plurality of circumferentially spaced recesses 30 formed in a radial wall 32 of the flange 28, a threaded end portion 34, and a plurality of flat surfaces 36 formed on a centrally disposed cylindrical body portion.

The reels 20 include, as viewed in FIG. 2, a left half portion 38 and a right half portion 40 joined by a plurality of bolts 42. The left half portion 38 includes a stepped bore which, when joined with the right half portion 40, forms an annular slot 44 extending radially outwardly from the internal bore of the reel 20, exposing a portion of the bolts 42. The right half portion 40 of the reel 20 includes a radially oriented aperture 46 extending between the inner and outer surfaces of a central cylindrical portion, and an axially oriented aperture 48 extending between the radial walls of a flange portion of the right half portion 40.

The brake assembly 22 includes a first reaction member 50 and a spaced second reaction member 52 both axially slideably mounted on the hub 16, a friction member 54 axially disposed between the first and second reaction members 50,52, and a means 56 for controllably, axially biasing at least one of the reaction members 50,52 toward one another and toward the friction member 54. The pair of reaction members 50,52 are preferably formed of steel and having a plurality of circumferentially spaced flat surfaces 58 formed on the inner periphery of the members 50,52 mating with the flat surfaces 36 formed on the central body portion of the hub 16. The first and second reaction members 50,52 are therefore axially moveable on the hub in a longitudinal direction along the shaft but are rotatably fixed with respect to the hub by engagement of the mating flat surfaces 36,58. The friction member 54 is preferably formed of an internally lubricated thermoplastic, such as a nylon and molydenum disulphide composite material, and has a plurality of circumferentially spaced, radially extending tabs 60 which are notched to receive an exposed portion of the bolts 42. Radial clearance is provided between the friction member 54 and hub 16, and is self-positioning between the pair of reaction members 50,52. The friction member 54 is therefore both axially and rotatably moveable with respect to the hub 54, but rotatably fixed with respect to the reel 20 by engagement of the tabs 60 with the bolts 42.

The biasing means 56 includes a plurality of circumferentially spaced springs 62 each respectively disposed in one of the recesses 30 formed in the flange 28 in an abutting relationship with the first reaction member 50, and a collar 64 threadably mounted on the threaded end portion 34 of the hub 16. The collar 64 has a plurality of axially oriented slots 66 formed on a radially outer surface of the collar 64. The slots 66 are alignable with either of the apertures 46,48 provided in the reel 20, enabling the collar to be selectively rotatably fixed with respect to the reel 20 by inserting an elongated pin or tool through the apertures 46,48 and into engagement with one of the slots 66.

Figure 4:
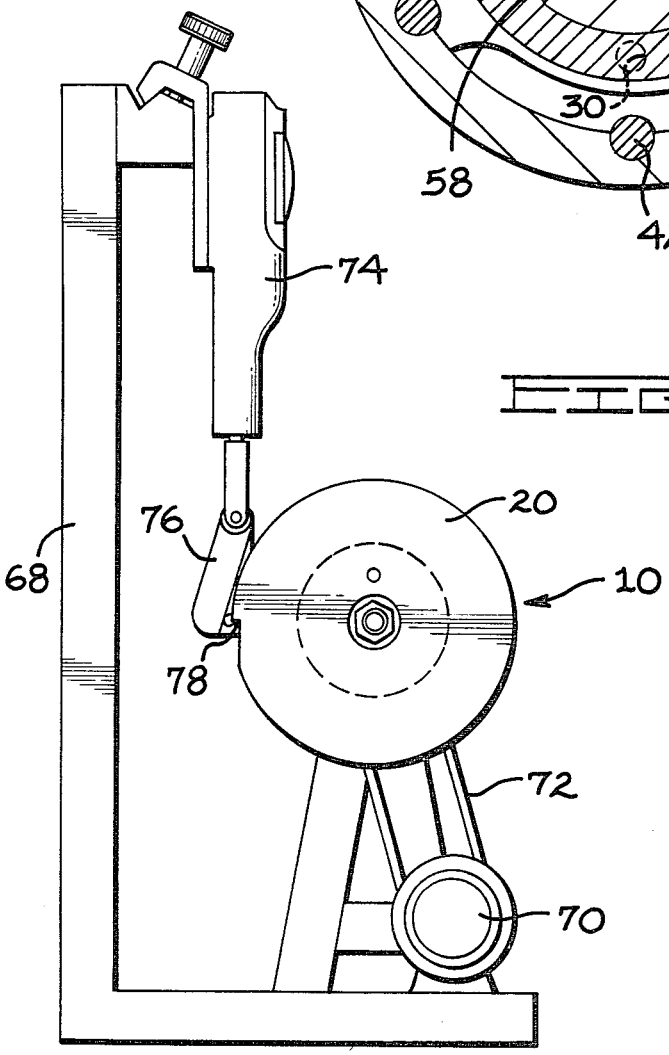
FIG. 4 is an end view of the bobbin assembly of the present invention mounted in a fixture for measuring the rotational resistance of the supply reel.

As shown in FIG. 4, a tension calibration fixture 68 is provided for measuring the resistance to rotation of the reel 20. The test fixture includes a motor 70 connected to the shaft 14 of a bobbin assembly 10 by a drive belt 72, and a dial indicator force gage 74 having a hook 76 adapted for engagement with a notch 78 provided on the outer periphery of at least one of the flange portions of the reels 20.

INDUSTRIAL APPLICABILITY

After assembly, as shown in FIG. 2, a plurality of spool assemblies are mounted on the shaft 14, and the nuts 26 are tightened to secure each of the hubs 16 in a fixed relationship on the shaft. The complete bobbin assembly 10, as shown in FIG. 1, typically includes five spool assemblies, each of which, after calibration and adjustment of the individual brake assemblies 22, will be filled with a supply of wire, not shown, from a bulk supply source.

In a typical application, a 12.7 mm (½ in.) dia. high pressure hose requires 75 to 90 individual strands of 0.3 mm (0.012 in.) dia. wire circumferentially applied at predetermined angles over one or more layers of elastomeric material previously formed over a mandrel. The 75 to 90 strands of wire are typically supplied from about 15 to 18 of the bobbin assemblies 10, each bobbin assembly 10 being mounted on a shuttle which rotates about the hose. As described above, it is desirable to maintain a constant torque force between the reel 20 and the shaft 24 and thereby maintain a predetermined tension on each of the 75 to 90 wires during application to the article. It has been found that a wire tension for wire delivered from a full bobbin of about 3 to 4 N (0.7 to 0.9 lbs.) on the wire is desirable.

The assembled bobbin assembly 10 is mounted on the tension calibration fixture 68 with the drive belt 72 operatively engaging the shaft 14 of the bobbin assembly 10. The motor 70 is started and operated at speeds sufficient to rotate the shaft 14 in a counter-clockwise direction as viewed in FIG. 4, at a typical operating speed as wire is dispensed from the reel 20 to an article being constructed. Typically, this speed will be about 9 to 18 rpm.

The pull, or resistance to rotation, exerted by each of the reels 20 of the bobbin assembly 10 is measured by engaging the hook 76 of the dial indicator force gage 74 into the notch 78 provided on each of the reels 20. The amount of torque force transmitted from the rotary shaft 14 to the reel is controlled by adjusting the collar 64 and thereby axially moving the reaction members 50,52. For example, if the indicator reading shows that the amount of pull exerted by the reel should be increased, a pin or similar elongated tool, is inserted through one of the apertures 46,48 provided in the reel and placed into engagement with one of the slots 66 formed in the collar 64. The coupled reel 20 and the collar 64 are then rotated together in a direction to cause the collar 64 to move the second reaction member 52 towards the first reaction member 50 and thereby increase the frictional contact between the reaction members 50,52 and the friction member 54. Conversely, if the amount of pull exerted by the reel 20 should be reduced, the coupled reel and collar are rotated in an opposite direction to that above to decrease the frictional contact between the respective reaction members 50,52 and friction member 54.

It should be noted that the radially oriented aperture 46 is particularly useful for adjusting the collar on empty reels of a multiple spool bobbin assembly. The axially oriented aperture 48 is provided if it should be necessary to adjust the tension of a reel 20 containing a predisposed supply of wire. In the latter case, it is necessary to place the desired spool assembly 12 at an end of the bobbin assembly, or alternatively arrange as a single spool on a shaft, to permit access to the axially oriented aperture 48.

In the end view of the tension calibration fixture shown in FIG. 4, only a single dial indicator force gage 74 is visible. It should be recognized that for multiple spool bobbin assemblies it is desirable to provide a dial indicator 74 and an attached hook 76 for each reel of the assembly. This practice eliminates the need to reposition the dial indicator 74 for each reel 20 of the bobbin assembly 10 and therefore decreases the time required for adjustment of each of the collars 64.

Other aspects, objects and advantages of this invention can be obtained from a study of the drawings, the disclosure and the appended claims.

What is claimed is:

1. In a bobbin assembly (10) for simultaneously dispensing a plurality of wires and controllably maintaining a predetermined tension on said wires, said assembly (10) having a shaft (14), and a plurality of reels (20) rotatably mounted on said shaft (14), the improvement comprising:

a plurality of hubs (16) each including a radial flange (28) having a plurality of circumferentially spaced recesses (30) formed in a radial wall (32) of said flange (28), each of said hubs (16) being removably mounted on said shaft (14) and positioned between said shaft (14) and a respective one of said reels (20);

means (24) for maintaining said hubs (16) in a fixed relationship with respect to said shaft (14);

first and second spaced reaction members (50,52) mounted on each of said hubs (16), at least one of said reaction members (50,52) on each hub (16) being axially moveable along the shaft (14) and each of said reaction members (50,52) being rotatably fixed on each hub (16);

a friction member (54) axially disposed between each of said first and second reaction members (50,52), each friction member (54) being axially moveable with respect to said hub (16) and rotatably fixed with respect to said reel (20); and, means (56) for controllably, axially biasing at least one of said reaction members (50,52) toward said respective friction member (54).

2. The bobbin assembly (10), a set forth in claim 1, wherein said assembly (10) includes a plurality of springs (62) respectively disposed in each of said recesses (30) in an abutting relationship with said first reaction member (50), and a collar (64) threadably mounted on said hub (16) in an abutting relationship with said second reaction member (52).

3. The bobbin assembly (10), as set forth in claim 2, wherein said collar (64) includes a slot (66) formed on a radially outer surface of said collar (64), and said reels (20) each include a radially oriented aperture (46) and an axially oriented aperture (48), said apertures (46,48) being alignably disposed with respect to said slot (66) formed in said collar (64).

4. The bobbin assembly (10), as set forth in claim 1, wherein said friction member (54) is formed of an internally lubricated thermoplastic material.

5. The bobbin assembly (10), as set forth in claim 4, wherein said friction member (54) is formed of a nylon and molybdenum disulphide composite material.

6. A bobbin assembly (10), comprising:

a shaft (14);

a plurality of hubs (16) removably mounted on said shaft (14);

means (24) for maintaining said hubs (16) in a fixed relationship with respect to said shaft (14);

a plurality of reels (20) each rotatably mounted on a respective hub (16);

a pair of reaction members (50,52) mounted on each of said hubs (16), said reaction members (50,52) being axially moveable along the shaft (14) and rotatably fixed with respect to said hub (16);

a friction member (54) axially disposed between each of said pair of reaction members (50,52), said friction member being axially and rotatably moveable with respect to a respective one of said hubs (16) and rotatably fixed with respect to a respective one of said reels (20); and, means (56) for controllably, axially biasing at least one of said reaction members (50,52) toward one another.

7. The bobbin assembly (10), as set forth in claim 6, wherein said hub (16) includes a radial flange (28) having a plurality of circumferentially spaced recesses (30) formed in a radial wall (32) of said flange (28), and said means (56) for axially biasing said pair of reaction members (50,52) includes a plurality of springs (62) respectively disposed in each of said recesses (30) in an abutting relationship with one of said pair of reaction members (50,52), and said assembly (10) includes a collar (64) threadably mounted on said hub (16) in an abutting relationship with the other one of said pair of reaction members (50,52).

8. The bobbin assembly (10), as set forth in claim 7, wherein said collar (64) includes a slot (66) formed on a radially outer surface of said collar (64), and said reels (20) each include a radially oriented aperture (46) and an axially oriented aperture (48), said apertures (46,48) being alignably disposed with respect to said slot (66) formed in said collar (64).

9. The bobbin assembly (10), as set forth in claim 6, wherein said first and second reaction members (50,52) are formed of metal, and said friction member (54) is formed of an internally lubricated thermoplastic material.

10. The bobbin assembly (10), as set forth in claim 9, wherein said friction member (54) is formed of a nylon and molybdenum disulphide composite material.

11. A spool assembly (12), comprising:

a shaft (14), a hub (16) having a radial flange (28), said hub (16) being removeably attached to said shaft (14);

a reel (20) having a radially oriented aperture (46) and an axially oriented aperture (48), said reel (20) being rotatably mounted on said hub (16);

a pair of reaction members (50,52) mounted on said hub (16) radially inwardly of said reel (20), said reaction members (50,52) being axially moveable and rotatably fixed with respect to said hub (16);

a friction member (54) mounted on said reel (20) radially inwardly of said reel and positioned between said pair of reaction members (50,52), said friction member (54) being axially moveable with respect to said hub (16) and rotatably fixed with respect to said reel (20);

a plurality of springs (62) disposed in a circumferentially spaced relationship between the radial flange (28) of said hub (16) and one of said pair of reaction members (50,52); and, a collar (64) threadably mounted on said hub (16) in an abutting relationship with the other one of said pair of reaction members (50,52) and having a slot (66) formed on a radially outer surface of said collar (64), the radially oriented aperture (46) and the axially oriented aperture (48) of said reel (20) being alignably disposed with respect to said slot (66).

12. The spool assembly (12), as set forth in claim 11, wherein said pair of reaction members (50,52) are formed of a metallic material and said friction member (54) is formed of an internally lubricated thermoplastic material.

13. The spool assembly (12), as set forth in claim 12, wherein said pair of reaction members (50,52) are steel, and said friction member (54) is formed of a nylon and molybdenum disulphide composite material.

* * * * *